US005322214A

United States Patent [19]

Jönsson et al.

[11] Patent Number: 5,322,214

[45] Date of Patent: Jun. 21, 1994

[54] OPENING ARRANGEMENT FOR A PACKAGING CONTAINER

[75] Inventors: Tommy Jönsson, Malmö ; Ulf Lindsjö, Lund, both of Sweden

[73] Assignee: Tetra Laval Holdings & Finance S.A., Pully, Switzerland

[21] Appl. No.: 83,263

[22] Filed: Jun. 29, 1993

[30] Foreign Application Priority Data

Jul. 2, 1992 [SE] Sweden ..... 9202042-9

[51] Int. Cl.[5] ..... B65D 5/72

[52] U.S. Cl. ..... 229/214; 229/160.2; 229/238; 229/239

[58] Field of Search ..... 229/123.1, 123.2, 125.42, 229/160.2, 213, 214, 238, 239

[56] References Cited

U.S. PATENT DOCUMENTS

| | | | |
|---|---|---|---|
| 3,330,436 | 7/1967 | Slomski | 229/123.1 |
| 3,606,136 | 9/1971 | Hegardt | 229/123.1 |
| 4,787,507 | 11/1988 | Rausing | 229/160.2 |
| 4,884,695 | 12/1989 | Kjelgaard | 229/123.1 |
| 5,039,564 | 8/1991 | Persson | 229/214 |
| 5,228,616 | 7/1993 | Kjelgaard | 229/123.1 |

FOREIGN PATENT DOCUMENTS

| | | | |
|---|---|---|---|
| 0471274 | 2/1992 | European Pat. Off. . | |
| 2528727 | 12/1976 | Fed. Rep. of Germany | 229/238 |
| 2734250 | 2/1979 | Fed. Rep. of Germany | 229/238 |
| 187697 | 2/1964 | Sweden | 229/238 |
| 412357 | 3/1980 | Sweden . | |
| 8802662-0 | 1/1990 | Sweden . | |
| 2189772 | 11/1987 | United Kingdom . | |

*Primary Examiner*—Gary E. Elkins

*Attorney, Agent, or Firm*—Burns, Doane, Swecker & Mathis

[57] ABSTRACT

An opening arrangement for packaging containers manufactured from a laminate material includes an opening strip that is inlaid in a transverse sealing fin of the packaging container. The opening strip extends through a longitudinal sealing seam of the packaging container so that a portion of the opening strip is located exteriorly of the packaging container. A part of the opening strip is coated on at least one side with a non thermosealable layer.

11 Claims, 2 Drawing Sheets

OPENING ARRANGEMENT FOR A PACKAGING CONTAINER

FIELD OF THE INVENTION

The present invention relates to an opening arrangement in a packaging container and more particularly to an opening arrangement in a packaging container produced from a plastic-coated packaging material and being of the type which is formed into a tube with a longitudinal sealing seam.

BACKGROUND OF THE INVENTION

Within the packaging industry, use is often made of a packaging material with a core of paper or cardboard laminated with thermoplastic and possibly a metal foil, e.g. aluminium foil, for the manufacture of single-use disposable packages or cartons for milk, juice or the like. The package is formed from a continuous material web or a material sheet. From, for example, a web, parallelepipedic packages are produced by uniting the longitudinal edges of the web with one another in a longitudinal overlap seam or joint to form a tube. The tube is filled with its intended contents and divided into closed packaging units by repeated transverse seals of the tube. In such instance, cushion-like packaging blanks are obtained which are thereafter finally formed into parallelepipedic packages.

In order to gain access to the contents of the package in a simple manner, some form of opening arrangement is required. In this instance, it is previously known in the art to inlay a tearing strip into one of the transverse sealing seams. Such an opening arrangement is described, for example in Swedish Patent Application No. S-9002640-2. By providing the packaging container with such an opening strip, there will be obtained an opening arrangement which, with a simple manual operation, opens the package and at the same time forms a part of the upper portion of the package into a pouring spout.

Such opening strips are often manufactured from a laminated plastic material in which one of the layers is cohesively broken upon so that a part of the opening strip is left in place on the inside of the packaging material. This is to prevent the packaging material from delaminating so that the inner layer of paper or cardboard is exposed to the liquid contents. However, it has been found that in the initial stage of the opening procedure, a certain delamination of the packaging material may take place with the above-described type of tearing strip.

OBJECTS AND SUMMARY OF THE INVENTION

One object of the present invention is to avoid such delamination of the packaging material taking place in the initial stage of the tearing-off of the opening strip.

A further object of the present invention is to obtain a distinct and easily identifiable marking on the outer portion of the opening strip.

These and other objects have been attained according to the present invention in that the opening arrangement of the type described above is constructed so that a part of the opening strip on at least one side is coated with a non thermosealable layer.

BRIEF DESCRIPTION OF THE DRAWING FIGURES

One preferred embodiment of the arrangement according to the present invention will now be described in greater detail hereinbelow, with particular reference to the accompanying drawing figures in which like elements are designated by like reference numerals and wherein.

DETAILED DESCRIPTION OF PREFERRED EMBODIMENT

Figure 1:
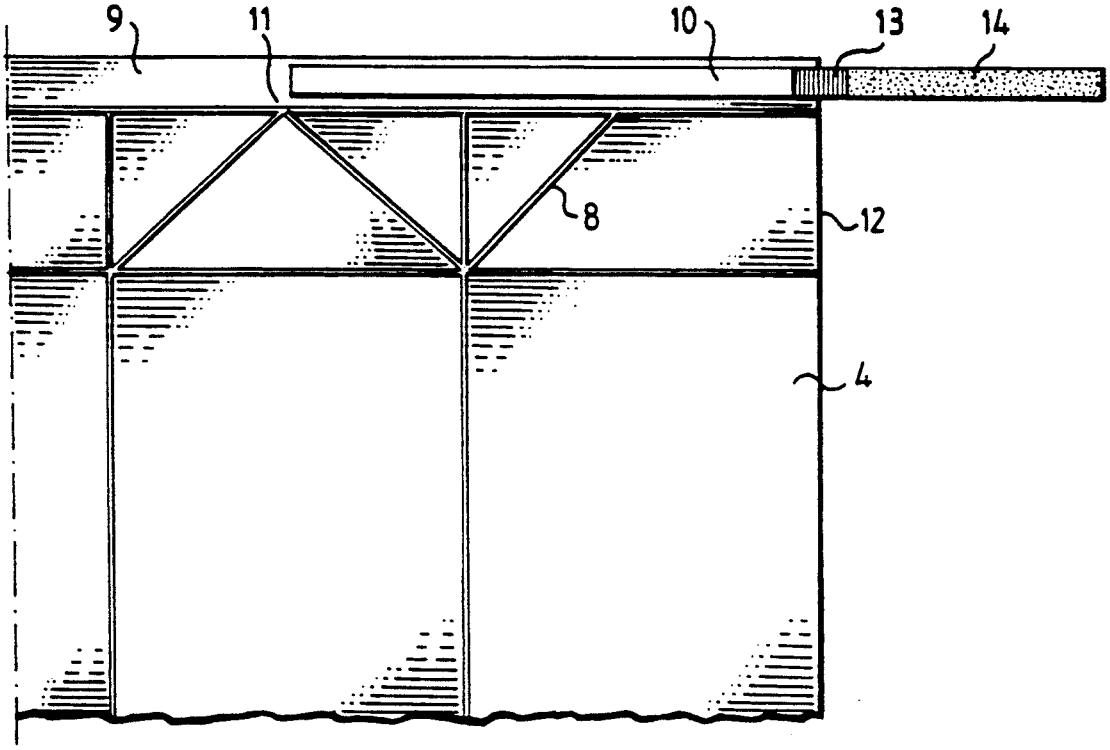
FIG. 1 is a plan view a portion of the packaging material with an inlaid opening strip.

A packaging container 1, of the type which is formed into a tube with a longitudinal overlap joint or seam 2 and is thereafter cut off into individual packages by means of transverse seals 3, can be manufactured from a continuous material web or a punched-out material sheet, a so-called blank. The packaging material 4 consists of a core 5 of paper or cardboard to which is laminated different layers of thermoplastic 6 and 7, and possibly a metal foil, preferably aluminium foil.

FIG. 1 shows a part of a packaging material 4 with crease lines 8 with the aid of which the package 1 is, in its final forming, folded into a parallelepipedic packaging container 1. In the region 9 where the transverse sealing takes place and which will form the upper sealing fin 3 of the packaging container 1, there is inlaid an opening strip 10. The opening strip 10 extends from the point 11 on the packaging material 4 where the packaging material 4 is folded in its transverse joint sealing 3. This point 11 will, at a later stage on an opened package 1, constitute the outermost point 11 of the pouring spout. From this point 11, the opening strip 10 extends outside the packaging material 4 whose outer defining line 12 will constitute the outer point of the longitudinal sealing joint or seam 2 of the package.

At the point 12 where the opening strip 10 is no longer in contact with the packaging material 4, there is shown, in FIG. 1, a region 13 surrounding on both sides the outer defining edge 12 of the material web and constituting the region 13 which is coated with a non thermosealable layer. This non thermosealable layer may consist of some form of printing ink of the type which is not heat sealable to polyethylene and which, moreover, is resistant to the sterile liquid used in the filling machine. At the marked region 13 of the opening strip 10 surrounding on both sides the edge line 12 of the packaging material 4, this non thermosealable layer is printed fully covering one side of the opening strip 10. The other side of the strip 10 may also be coated with a non thermosealable layer. However, experiments have demonstrated that a good opening of the package 1 will be obtained with only one side of the strip 10 coated. On application to the packaging material 4, the opening strip 10 is turned so that the non thermosealable layer faces towards the inside layer 7 of the packaging material 4. The region 13 coated with the non thermosealable layer constitutes approximately 4–6 mm of the opening strip 10, with a certain tolerance for application such that this region 13 always extends 2–3 mm on either side of the outermost edge 12 of the packaging material 4.

By employing a non thermosealable layer consisting of a printing ink in a colour which differs from that of the remainder of the packaging container 1, it is possible, by hatching the remaining portion 14 of the projecting opening strip 10, to obtain a colour marking which indicates where the opening strip 10 is located. If use is made of a printing ink colour which differs from that of the non thermosealable layer, a degree of hatching should be employed which is sufficient to make for easy identification of the opening strip 10. Nor should the hatching be denser than permits the opening strip 10 on the exteriorly finished package 1 to be fixed to the outer side of the package 1. A suitable degree of hatching is 20 to 70% of the surface.

Figure 2:
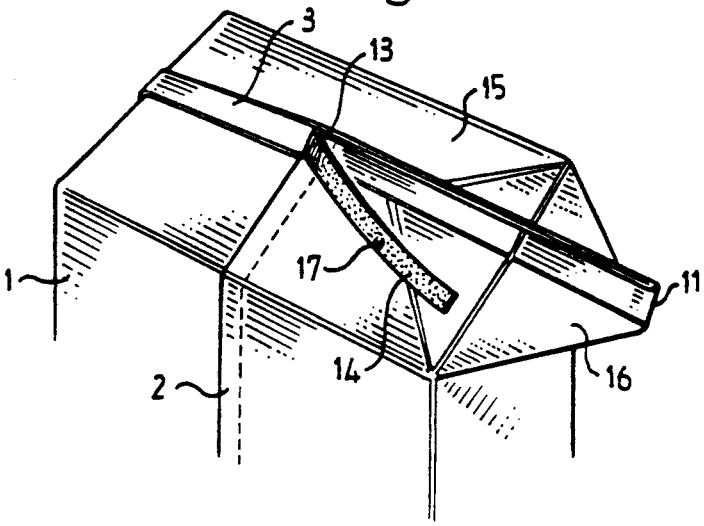
FIG. 2 is a top perspective view of the upper portion of an unopened packaging container with an opening arrangement according to the present invention.

FIG. 2 shows the upper portion 15 of a ready-formed package 1 provided with an opening arrangement according to the invention. On the packaging container 1 in FIG. 2, the one gable flap 16 which is to form a pouring spout is raised from its lowered distribution position. The opening strip 10 is shown against the upper side 15 of the packaging container 1. The opening strip 10 extends out through the longitudinal sealing joint or seam 2 of the package 1 in which begins the region 13 coated with the non thermosealable layer, and thereafter extends outwardly outside the packaging container 1. A distance outside the longitudinal sealing seam 2, the region 14 of the opening strip 10 which is hatched begins. Given that the degree of hatching is such that a certain sealing is still possible, the opening strip 10 is fixed against the upper side 15 of the packaging container 1 by means of a point seal 17 so as to avoid the risk that the opening strip 10 catches in other packages 1 during distribution and handling.

Figure 3:
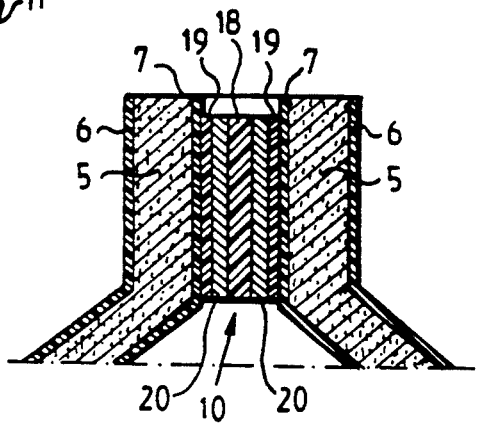
FIG. 3 is a cross-sectional view of the sealing fin of an unopened packaging container.

FIG. 3 shows a cross section of the upper sealing fin 3 of the packaging container 1, and how the opening strip 10 can be built-up. Outer layers 19 of sealable plastic material, preferably polyethylene, are laminated about an inner layer 18 of a tensile strength material, preferably polyester. Between the inner layer 18 and the outer adhesion layers 19, there is an intermediate layer 20 of a material of such a nature that the adhesive bonding force between all material layers included in the opening strip 10 and with the outer layers 19 of the opening strip and the inner thermoplastic layer 17 of the packaging material is considerably greater than the internally cohesive bonding force in the intermediate layer 20 itself.

Figure 4:
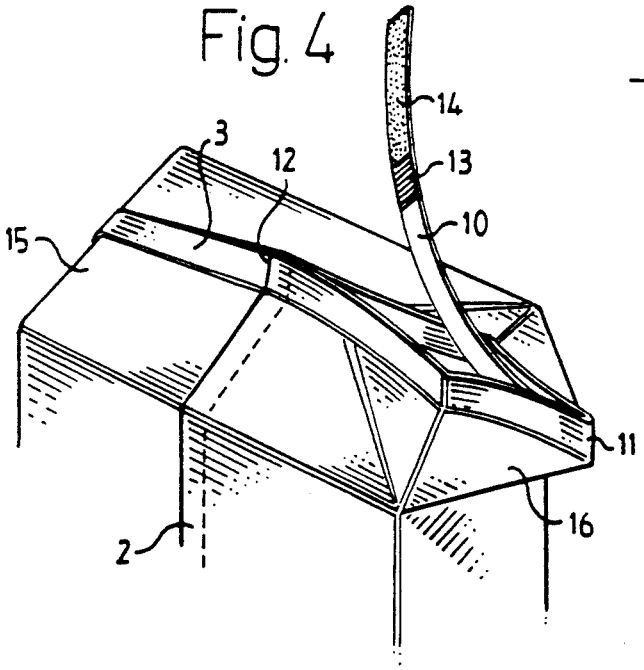
FIG. 4 is a top perspective view of the packaging container in the process of being opened.
Figure 5:
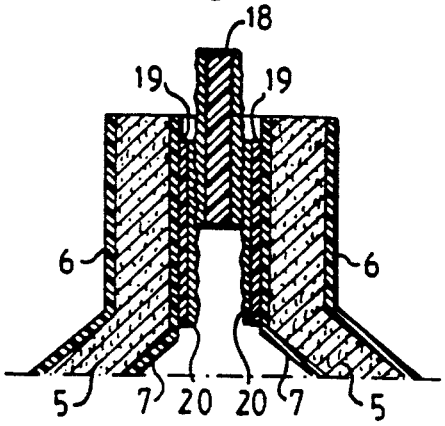
FIG. 5 is a cross-sectional view of a sealing fin of the packaging container during the opening operation.

FIG. 4 shows the packaging container 1 in the process of being opened. The opening strip 10 is removed from its point seal 17 on the upper side 15 of the packaging container 1 and is pulled upwards. The opening strip 10 is then cohesively broken in the layer 20 as shown in FIG. 5. Since the opening strip 10 in the initial stage of the opening operation is coated, in a region 13, with a non thermosealable layer which extends over the edge 12 of the packaging material 4, the opening strip 10 cannot, during tearing-off, become caught in the edge 12 of the packaging material 4 and thereby delaminate the packaging material 4. At the same time as the opening strip 10 is pulled upwards, the pouring spout will be formed which makes the liquid contents accessible. By providing the sealing fin 3 of the packaging material 4 with prefabricated perforations, the pouring spout may be formed easily and distinctly so that, after tearing-off of the opening strip 10, it is possible to pour the contents directly from the package.

As will be apparent from the above description, the present invention realizes an opening arrangement with an opening strip 10 inlaid in the upper sealing fin 3 of the packaging container 1. This strip does not suffer from the problems and drawbacks inherent in prior art opening strips. At the same time, there will be obtained a colour indication which directly shows the position of the opening strip 10, thereby facilitating opening of the package 1.

While this invention has been illustrated and described in accordance with a preferred embodiment, it is recognized that variations and changes may be made, and equivalents employed herein, without departing from the invention as set forth in the claims.

What is claimed is:

1. An opening arrangement in a packaging container which is produced from a plastic-coated packaging material and which is formed into a tube with a longitudinal sealing seam, the container including a plurality of container walls and a sealing fin extending transversely over one of the container walls, the sealing fin resulting from opposing packaging material layers being united with one another, the opening arrangement comprising an opening strip inlaid in the sealing fin and extending through the longitudinal sealing seam of the packaging container so that a portion of the opening strip is located exteriorly of the packaging container, a part of the opening strip on at least one side being coated with a non thermosealable layer.

2. The opening arrangement as claimed in claim 1, wherein the non thermosealable layer is located on a side of the opening strip which, in the longitudinal sealing seam of the packaging container faces towards the inside of the packaging container.

3. The opening arrangement as claimed in claim 1, wherein the non thermosealable layer begins inside the longitudinal sealing seam and extends a distance outside the packaging container.

4. The opening arrangement as claimed in claim 1, wherein the part of the opening strip coated with the non thermosealable layer extends 2–3 mm on both sides of an outermost edge of the packaging material.

5. The opening arrangement as claimed in claim 1, the region of the non thermosealable layer extending outside the packaging container merges into a hatched region wherein a portion of the opening strip located adjacent the part that is coated with a non thermosealable layer is provided with a color marking.

6. The opening arrangement as claimed in claim 5, wherein the opening strip is point sealed to the container.

7. The opening arrangement as claimed in claim 1, wherein the opening strip is produced from a laminate that includes an inner layer, an outer layer positioned on opposite sides of the inner layer and an intermediate layer positioned between the inner layer and each outer layer, the opening strip being formed so that the intermediate layers of the opening strip break when the opening strip is pulled.

8. A packaging container produced from plastic-coated packaging material comprising a plurality of container walls, a longitudinal sealing seam, a sealing fin formed by opposing layers of said packaging material being united with one another, said sealing fin extending transversely over one of the container walls, and an opening arrangement for providing access to an interior of the container, said opening arrangement comprising an opening strip inlaid in the sealing fin and extending through the longitudinal sealing seam so that a portion of the opening strip is located exteriorly of the container, at least a part of the opening strip being coated on at least one side with a non thermosealable layer.

9. The packaging container according to claim 8, wherein a portion of the opening strip is provided with a color marking.

10. The packaging container according to claim 9, wherein the opening strip is point sealed to an exterior surface of one of the container walls.

11. The packaging container according to claim 8, wherein the part of the opening strip that is coated with the non thermosealable layer extends about 2–3 mm beyond an outer surface of the container.

* * * * *